US006641676B1

(12) United States Patent
Bently

(10) Patent No.: US 6,641,676 B1
(45) Date of Patent: Nov. 4, 2003

(54) FLUID POWERED-SCOURING WHIP FOR CLEANING REMOTE AREAS

(76) Inventor: John F. Bently, 11153 S. Wilton River Rd., New Richland, MN (US) 56072

( * ) Notice: Subject to any disclaimer, the term of this patent is extended or adjusted under 35 U.S.C. 154(b) by 158 days.

(21) Appl. No.: 10/014,263

(22) Filed: Oct. 22, 2001

(51) Int. Cl.[7] ..... B08B 7/00

(52) U.S. Cl. ..... 134/6; 134/8; 134/22.12; 134/22.18; 15/104.05; 15/104.16; 15/104.2; 15/188; 15/304; 15/395; 15/406

(58) Field of Search ..... 134/6, 8, 22.12, 134/22.18; 15/104.5, 104.16, 104.2, 188, 304, 395, 406

(56) References Cited

U.S. PATENT DOCUMENTS

| | | | | | |
|---|---|---|---|---|---|
| 2,982,971 | A | | 5/1961 | Garaway | |
| 4,041,563 | A | | 8/1977 | Steeves | |
| 4,356,582 | A | * | 11/1982 | Stephenson | 15/1.7 |
| 4,651,377 | A | * | 3/1987 | Staples | 15/1.7 |
| 4,792,363 | A | * | 12/1988 | Franklin et al. | 134/8 |
| 4,984,329 | A | | 1/1991 | Wade | |
| 5,109,567 | A | | 5/1992 | Harrison | |
| 5,168,593 | A | * | 12/1992 | Poje et al. | 15/104.2 |
| 5,347,677 | A | | 9/1994 | Prentice | |
| 5,383,243 | A | * | 1/1995 | Thacker et al. | 15/104.18 |
| 5,608,941 | A | | 3/1997 | Kleinfeld | |
| 5,617,609 | A | | 4/1997 | Bently | |
| 5,735,016 | A | | 4/1998 | Allen | |
| 5,802,667 | A | | 9/1998 | Williams | |
| 5,868,858 | A | | 2/1999 | Creed | |
| 6,122,792 | A | * | 9/2000 | Roy | 15/104.2 |
| 6,269,519 | B1 | | 8/2001 | Harvey | |
| 6,286,172 | B1 | * | 9/2001 | Castagnoli | 15/104.19 |
| 6,293,735 | B1 | | 9/2001 | Klobucar | |

* cited by examiner

*Primary Examiner*—Zeinab El-Arini

(57) ABSTRACT

The fluid-powered scouring whip is a length of flexible tubing composed of rubber or plastic. One or more scouring members, such as bristles or tines, extend outward from the tubing. These scouring members are molded or tooled as integral parts of the tubing, and may be configured in a variety of angles, densities, patterns or lengths.

The fluid-powered scouring whip would be attached to a source of rapidly moving fluid. The whip would be introduced into a remote area in need of cleaning, such as an air duct. When fluid was introduced through the fluid-powered scouring whip, the whip would move about rapidly and randomly, scouring the surfaces of the area into which it had been introduced.

2 Claims, 2 Drawing Sheets

FLUID POWERED-SCOURING WHIP FOR CLEANING REMOTE AREAS

BACKGROUND OF THE INVENTION

This invention relates to removing undesirable dust, dirt and other debris from remote locations, specifically to dislodging such dust, dirt and other debris from areas which are difficult to reach, and therefore require special means to clean.

For dislodging dust or unwanted debris from remote, difficult to reach locations, such as the interior of air ducts, many different means have been employed. Most air duct cleaners use vacuum equipment to induce rapid airflow within ductwork, creating a tendency for loose dust to be drawn along with the air, but this rapid airflow does not remove dust or unwanted material which has become settled or lodged on interior surfaces. Such debris often builds up gradually over time, and has frequently formed a cohesive "pad" which cannot be removed by rapid airflow alone.

One of the longest-standing methods for dislodging such unwanted dust and debris is the introduction of fast-moving air directed by nozzles. While using nozzles alone does dislodge some of the material and does break up "pads" of material on the bottom of ductwork, thus allowing some of the unwanted material to be drawn away by rapid airflow, such nozzles do not remove all material, and so must be introduced to an area several times to dislodge the majority of the dust. Also, since the effectiveness of a nozzle depends both upon the operators' ability to see the unwanted material and the nozzle, and upon the operators' ability to maneuver the nozzle toward uncleaned areas, using nozzles is relatively inefficient when it is difficult to see into the remote area being cleaned.

Another common method for dislodging dust or unwanted material from remote areas is to introduce brushes. Brushes often have a larger effective cleaning radius than nozzles, but also exhibit several disadvantages. Like nozzles, brushes are most effective when they and the material to be dislodged are visible. Thanks to their larger size, brushes often cannot be maneuvered into tight areas, such as behind wiring or interior structures within the remote area. Brushes must also be maneuvered using long handles or rods, which create difficulties when trying to turn comers or reach far into remote locations. Rotating brushes have also become relatively common, but these continue to suffer from these disadvantages.

Whips and whip systems have also come into use for dislodging unwanted material from remote and difficult to clean areas. A fairly recent innovation in the cleaning of remote areas is the use of fluid-powered whips combined with directed airflow to dislodge and remove dust and debris. The current applicant is the holder of U.S. Pat. No. 5,617,609, for a system of such type.

It is in the nature of a flexible whip to swing about rapidly and randomly once a rapidly-moving fluid is channeled through it. This rapid and random motion causes the whip to strike and sweep in all directions, thus dislodging material without it being necessary that the operator be able to see the whip to continue cleaning. The length of the whip and the speed of airflow can be adjusted to clean areas of varying sizes.

A disadvantage of using a flexible whip system for cleaning remote areas is the small surface area of the whip. The whip may take longer than a brush to dislodge dust from a large area, or may be less effective at reaching into comers or confined areas.

BRIEF SUMMARY OF THE INVENTION

It is the nature of the present invention to enhance the reach and effectiveness of the whip cleaning process by adding integral scouring elements such as bristles or tines to a whip, thus making use of the many positive attributes of the whip and the large, flexible surface area provided by a brush. Such a bristled whip would be especially helpful at reaching into corners, and at helping remove large areas of pad-like dust. Bristled whips can be configured differently for different applications. Configurations might include, but not be limited to, many bristles close together at one end, fewer bristles further apart along the length of the whip, sturdier or finer bristles, shorter or longer bristles, bristles at angles other than perpendicular to the flexible whip tubing, bristles of different lengths on the same flexible whip tubing, or any combination of the above.

With the combined advantages of the whip and the brush, the bristled whip becomes a more efficient scouring device than either a whip or a brush used individually.

DETAILED DESCRIPTION OF THE INVENTION

Figure 1:
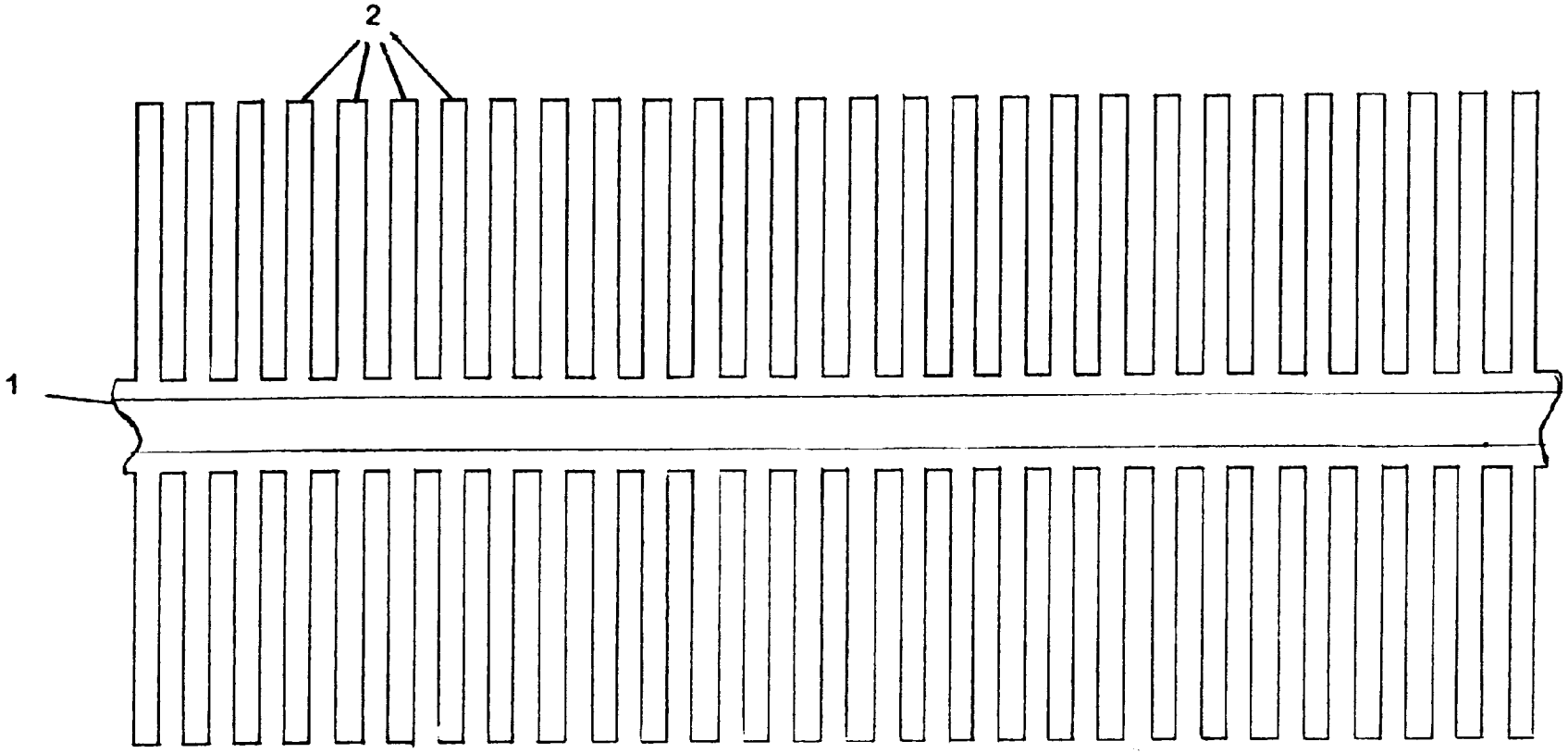
FIG. 1 shows an embodiment of the present invention, with scouring members (2) protruding outward from the flexible material (1). This view is from the side, and shows an embodiment of the invention with evenly spaced scouring members along the full length of the flexible material.
Figure 2:
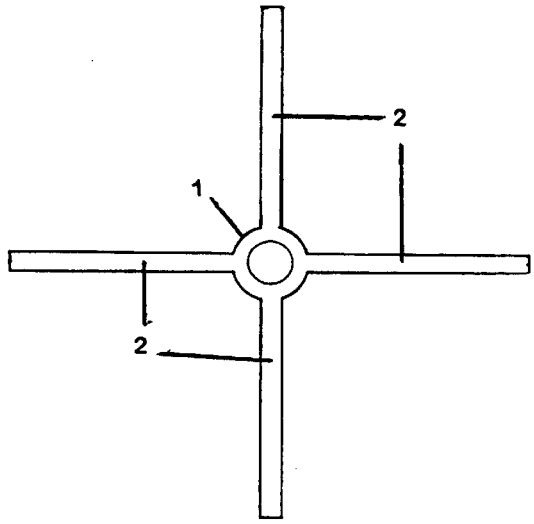
FIG. 2 shows an end view of an embodiment of the present invention. In this figure, the bristled whip has four rows of scouring members (2) protruding outward from the flexible material (1).
Figure 5:
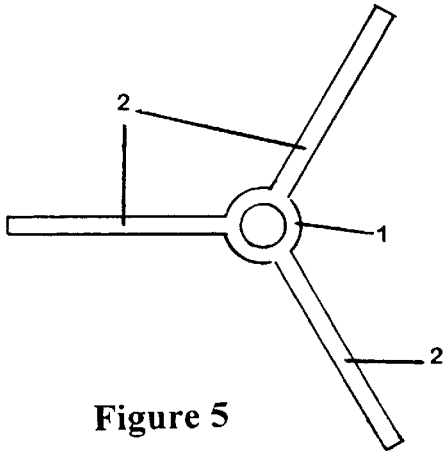
FIGS. 3, 4 and 5 show end views of an embodiment of the present invention. In these figures, the bristled whip has, respectively, one, two, and three rows of scouring members (2) protruding outward from the length of flexible material (1).
Figure 3:
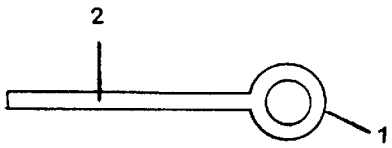
Figure 4:
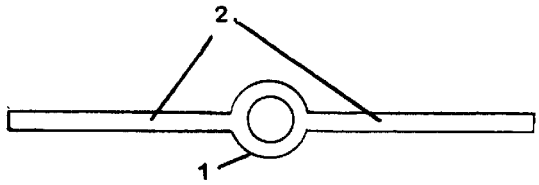

The current invention is a fluid-powered scouring whip for cleaning remote areas. This whip is an improvement upon past whip cleaning systems because it combines the advantages of a brush—namely a larger cleaning surface, the ability to scour into corners or confined spaces, and the ability to clean quickly—with the advantages of a whip—namely the ability to clean without being able to see the area being cleaned, and smaller size, which gives it access to more confined or difficult to reach areas.

The fluid-powered scouring whip is a length of flexible tubing composed of rubber or plastic. One or more scouring members, such as bristles or tines, extend outward from the tubing. These scouring members are molded or tooled as integral parts of the tubing, and may be configured in a variety of angles, densities, patterns or lengths.

The fluid-powered scouring whip would be attached to a source of rapidly moving fluid. The whip would be introduced into a remote area in need of cleaning, such as an air duct. When fluid was introduced through the fluid-powered scouring whip, the whip would move about rapidly and randomly, scouring the surfaces of the area into which it had been introduced.

It is believed that the construction, operation and advantages of this invention will be apparent to those skilled in the art. It is to be understood that the present disclosure is illustrative only and that changes, variations, substitutions, modifications and equivalents will be readily apparent to one skilled in the art and that such may be made without departing from the spirit of the invention as defined by the following claims.

I claim:

1. A fluid-powered scouring whip for use with a source of rapidly moving fluid to clean surfaces, comprising:

a length of flexible tubing composed of rubber or plastic, the flexible tubing having an outer surface and a plurality of integrally formed scouring members projecting from its the outer surface; and, the flexible tubing having a hollow core along the length of flexible tubing and the hollow core having a first end and a second end, wherein rapidly moving fluid can be introduced through the first end of the sore and pass through the length of flexible tubing and out the second end of the core thereby causing the flexible tubing and the scouring members to move about rapidly and randomly to clean surfaces in an area where the flexible tubing is located.

2. A method for cleaning a surface comprising:

providing a fluid sourc;

connecting a length of flexible tubing composed of rubber or plastic to the fluid source, the flexible tubing having an outer surface and a plurality of integrally formed scouring members projecting from the outer surface; and, introducing a fluid from the fluid source into and through the flexible tubing thereby causing the flexible tubing and the scouring members to whip about rapidly and randomly and dislodge materials from the surface to be cleaned.

* * * * *

UNITED STATES PATENT AND TRADEMARK OFFICE

CERTIFICATE OF CORRECTION

PATENT NO. : 6,641,676 B1
DATED : November 4, 2003
INVENTOR(S) : John F. Bently

It is certified that error appears in the above-identified patent and that said Letters Patent is hereby corrected as shown below:

Column 4,
Line 5, delete "sourc" and insert therefor -- source --.

Signed and Sealed this

Twenty-fourth Day of May, 2005

JON W. DUDAS
*Director of the United States Patent and Trademark Office*